United States Patent [19]

Wada et al.

[11] Patent Number: 4,724,361

[45] Date of Patent: Feb. 9, 1988

[54] HIGH PRESSURE DISCHARGE LAMP

[75] Inventors: Shigeaki Wada, Osaka; Atsunori Okada, Kashiwara; Shoiti Morii, Hirakata, all of Japan

[73] Assignee: Matsushita Electric Works, Ltd., Osaka, Japan

[21] Appl. No.: 804,867

[22] Filed: Dec. 5, 1985

[30] Foreign Application Priority Data

| | | | |
|---|---|---|---|
| Dec. 14, 1984 | [JP] | Japan | 59-265052 |
| Jan. 17, 1985 | [JP] | Japan | 60-6199 |
| May 14, 1985 | [JP] | Japan | 60-102249 |
| Jun. 21, 1985 | [JP] | Japan | 60-136330 |
| Jun. 21, 1985 | [JP] | Japan | 60-136331 |
| Jun. 21, 1985 | [JP] | Japan | 60-136332 |

[51] Int. Cl.[4] ..... H05B 41/16; H05B 41/24

[52] U.S. Cl. ..... 315/246; 313/634; 313/631; 315/DIG. 5; 315/DIG. 7; 315/209 R

[58] Field of Search ..... 315/DIG. 5, DIG. 7, 315/209 R, 246; 313/634, 631

[56] References Cited

U.S. PATENT DOCUMENTS

| | | | |
|---|---|---|---|
| 3,890,537 | 6/1975 | Parks et al. | 315/209 |
| 4,052,636 | 10/1977 | Strok | 313/631 |
| 4,170,746 | 10/1979 | Davenport | 315/DIG. 7 |
| 4,373,146 | 2/1983 | Bonazoli et al. | 315/209 |
| 4,503,356 | 3/1985 | Kobayashi et al. | 313/634 |
| 4,527,097 | 7/1985 | Heijden et al. | 315/246 |
| 4,535,271 | 8/1985 | Holmes | 315/DIG. 7 |

FOREIGN PATENT DOCUMENTS 48095 5/1981 Japan .

*Primary Examiner*—Saxfield Chatmon

*Attorney, Agent, or Firm*—Burns, Doane, Swecker & Mathis

[57] ABSTRACT

A high pressure discharge lamp wherein an arc tube is so formed at least at one end portion as to satisfy a predetermined condition, unlike any known configuration and dimensions of the arc tube end portion, to restrain occurrence of acoustic resonance phenomenon for reducing zones in which the phenomenon occurs at least to be below 50% and effectively preventing any adverse influence of the phenomenon on discharge arc column.

10 Claims, 52 Drawing Figures

SP
S
X
Lr2
2R
L
Lp
PERIPERAL WALL

1
FMR
16a
INSTABLE ZONE (IZ) %
100
50
0
0.2
0.4
0.6
(DIMENSION OF TUBE END PORTION /INTERNAL DIAMETER DTE ID)

SLF
20a
21a
19a
IZ(%)
DTE/ID

HIGH PRESSURE DISCHARGE LAMP

TECHNICAL BACKGROUND OF THE INVENTION

This invention relates to high pressure discharge lamps which are lighted by means of a high frequency power source.

The luminous efficiency of the discharge lamps of the type referred to can be improved by lighting them with an application of a voltage of more than several KHz by means of a high frequency power source, to be effectively utilizable as a long hour illumination source such as a metal halide lamp.

DISCLOSURE OF PRIOR ART

Conventional high pressure discharge lamps generally comprise, for example, an arc tube made of a quartz glass or the like housed within a gas-charged outer jacket, and a pair of electrodes mounted in the arc tube with a rare gas and luminous substance sealed therein. It is known that, in addition to the improved luminous efficiency achieved by lighting such lamps by a high frequency power source, their lighting circuit can be electronically manufactured to allow required stabilizer to be minimized in size and weight.

In these high pressure discharge lamps, on the other hand, there has been involved such a risky drawback that, upon coincidence of the natural frequency of the arc tube with a pressure variation inside the tube due to the lighting, a stationary wave thereby made to arise causes an acoustic resonance phenomenon to occur, whereby a discharge arc column generated in the tube is caused to be warped, flickered or eventually extinguished, or even a destruction or the like damage of the tube is caused to occur, and it has been a common demand that the lamps be improved in this respect.

In an attempt to eliminate the above problem, there have been suggested various measures, examples of which are disclosed in be U.S. Pat. No. 4,373,146 of R. P. Bonazoli et al and Japanese Patent Appln. Laid-Open Publication No. 48095/1981 of Y. Koshimura et al. The U.S. Patent discloses a high intensity discharge lamp which is driven by an A.C. output through an inverter receiving a square wave kept at 20–30 KHz or 25–50 KHz from a square wave generator for a frequency modulation. The Japanese Publication discloses a high pressure discharge lamp based on a technical idea similar to the U.S. patent but in which, specifically, an output frequency of a high frequency power source device is modulated by a modulator in a zone including a stable lighting zone of the discharge lamp. While these suggestions are effective to eliminate the acoustic resonance phenomenon to some extent, they still involve a problem that, when zones in which the acoustic resonance phenomenon occurs (which zones shall be hereinafter referred to simply as "instable zone") are considered as based on, for example, two functions of a center frequency of 30–60 KHz and a modulation frequency range of 0–10 KHz upon the lamp lighting by means of a high frequency power source, the creation of a sufficiently broad zone in which the acoustic resonance phenomenon is avoidable (which zone shall be hereinafter referred to simply as "avoidable zone") requires a remarkably complicated electronic circuit so that the required costs for avoiding the acoustic resonance phenomenon would be extremely high.

TECHNICAL FIELD OF THE INVENTION

A primary object of the present invention, therefore, is to provide a high pressure discharge lamp which can reduce the instable zone to a large enough extent to obtain an avoidable zone which is sufficiently broad and effective to lower the required costs for avoiding the acoustic resonance phenomenon.

According to the present invention, this object can be attained by providing a high pressure discharge lamp having an arc tube housed in an outer jacket and lighted by a frequency modulated power from a high frequency power source for avoiding the acoustic resonance phenomenon, wherein the arc tube satisfies an equation $$S \leqq \pi D^2(\tfrac{1}{2}-(5/11)x)^2,\ 0<X\leqq 11/15 \qquad (1)$$

where D is the inner diameter (mm) of the arc tube at its substantial cylindrical part, X is a quotient of a distance "x" (mm) divided by the inner diameter D mm, the distance "x" being the one from an end of the substantial cylindrical part to an axially outer point, and S is a sectional area ($mm^2$) of the tube at the distance "x".

Other objects and advantages of the present invention shall be made clear in the following description of the invention detailed with reference to preferred embodiments shown in the accompanying drawings.

BRIEF EXPLANATION OF THE DRAWINGS

FIGS. 51*a* through 51*d* are graphs similar to FIG. 5, wherein FIGS. 51*a* to 51*c* show the acoustic resonance phenomenon observed in the case of the arc tube of FIG. 49 made to be of an output of 400W, and FIG. 51*d* shows the similar phenomenon in the case of such arc tube as shown in FIG. 52 made also to be of the output 400W.

Figure 1:
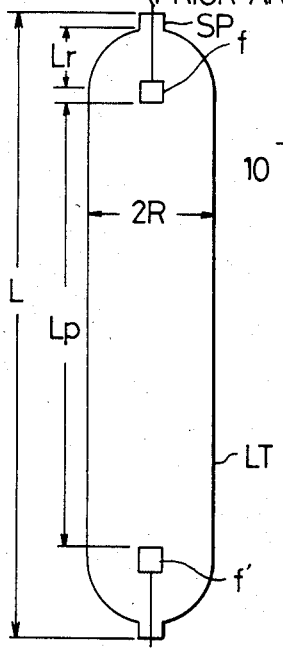
Fig. 1 (PRIOR ART)
FIG. 1 is a diagram for explaining the acoustic resonance phenomenon in a known arc tube for the high pressure discharge lamp.

While the present invention shall now be described with reference to the preferred embodiments shown in the drawings, it should be understood that the intention is not to limit the invention only to the particular embodiments shown but rather to cover all alterations, modifications and equivalent arrangements possible within the scope of appended claims.

DISCLOSURE OF PREFERRED EMBODIMENTS

According to a remarkable feature of the present invention, in the high pressure discharge lamp lighted by means of a high frequency power source subjected to a frequency modulation (FM), the acoustic resonance phenomenon generally occurring in the lamp thus lighted is made avoidable by so forming an end portion of the arc tube housed within an envelope charged with a gas as to satisfy the foregoing equation (1).

For a better understanding of the present invention, references shall first be made to the acoustic resonance phenomenon (which shall be hereinafter referred to simply as "AR phenomenon") which the present invention concerns. The AR phenomenon is induced by a stationary wave caused to occur upon coincidence of the natural frequency determined by the configuration and charged substances of the arc tube with the pressure variation inside the arc tube due to time variation under an application of input power to the tube from a high frequency power source. Here, an assumption is made that, as shown in FIG. 1, the arc tube LT is of a cylindrical shape, and a system of cylindrical coordinates shall be set up with a radial direction "r", circumferential direction "$\theta$" and axial direction "z". In this case, fundamental frequencies $F_r$, $F_\theta$ and $F_z$ of the AR phenomenon in the respective directions r, $\theta$ and z will be as follows:

r-direction resonance: $F_r = 3.83C/2\pi R$ $\theta$-direction resonance: $F_\theta = 1.84C/2\pi R$ z-direction resonance: $F_z = C/2L$ where L is the entire length of the arc tube LT, R is the radius of the tube, and C is the sound velocity within the tube determined by the temperature within the tube.

That is, $C=\sqrt{\gamma PT/M}$, where $\gamma$ is a ratio "specific heat at constant pressure/specific heat at constant volume", P is a gas constant, T is a temperature within the arc tube, and M is an average atomic weight of the charged substances.

The AR phenomenon occurs within the arc tube actually at frequencies corresponding to an integer multiple of the foregoing fundamental frequencies, and the energy of such AR phenomenon has an adverse influence upon a stable discharge-sustaining force of an arc column established between electrodes f and f' within the arc tube LT during its lighting.

Figure 2:
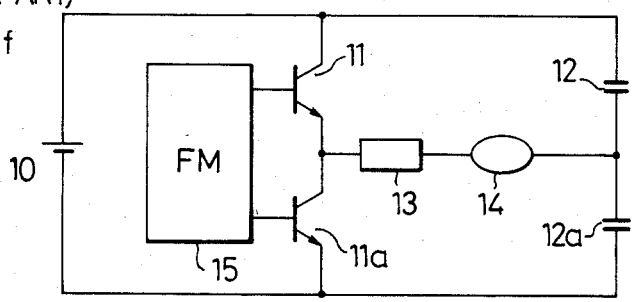
FIG. 2 shows an example of a frequency-modulation type high-frequency lamp lighting circuit used for observations of the acoustic resonance phenomenon.

According to one feature of the present invention, the AR phenomenon is effectively avoided by substantially flattening at least one end of the arc tube for use in the high pressure discharge lamp. That is, the present inventors have noticed that the configuration of the arc tube contributes to the occurrence of the AR phenomenon in the arc tube and, through extensive measurement of the AR phenomenon for arc tubes of variously modified configurations, have found that the AR phenomenon can be avoided by substantially flatening at least one end portion of the arc tube. For the measurement of the AR phenomenon, such a lighting circuit as shown in FIG. 2 as an example has been used for the high pressure discharge lamp, in which circuit a pair of switching elements 11 and 11*a* are connected in series with a D.C. power source 10 and in parallel to capacitors 12 and 12*a*, a series circuit of a current limiting element 13 and high pressure discharge lamp 14 is provided between a junction of the pair of switching elements 11 and 11*a* and a junction of the pair of capacitors 12 and 12*a*, and a freqeuncy modulator 15 is connected at its output terminals to the respective bases of the switching elements 11 and 11*a* for supplying a high frequency power as frequency modulated to the high pressure discharge lamp 14. Further, the supplied power has been set to have a center frequency of 20 to 100 KHz in order to avoid audible frequency zone and radiation electromagnetic waves.

Figure 3:
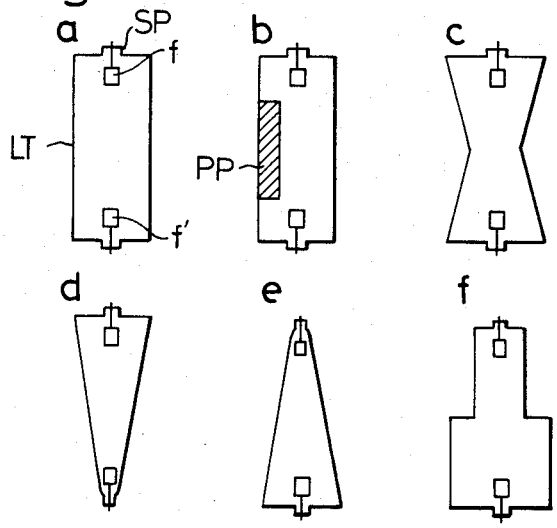
FIGS. 3*a* to 3*f* are schematic views of various arc tubes for the high pressure discharge lamp according to the present invention, with which tubes the acoustic resonance phenomenon is avoidable.
Figure 4:
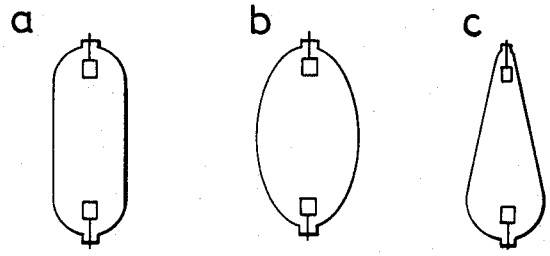
FIGS. 4*a* to 4*c* are schematic views of examples of arc tubes with which the acoustic resonance phenomenon is not avoidable.

Referring to FIGS. 3 and 4, there are shown arc tubes of various configurations in which the presence or absence of the AR phenomenon was investigated. The arc tubes LT of FIGS. 3*a* to 3*f*, substantially flattened at least at one end portion, have proved that the AR phenomenon is avoidable in a considerable number of zones, whereas such tubes as shown in FIGS. 4*a* to 4*c* modified in shape only to some extent have failed to effectively avoid the occurrence of the phenomenon so long as their both end portions remain curved. Here, the term "end portion" refers to a portion of the arc tube to which the configurational and dimensional features of the present invention relate, excluding inherently existing small endwise projections SP for hermetically holding terminal stems of the filament electrodes f and f', that is, the portion of such distance $L_r$ as in FIG. 1 which is to be defined as (3±2 mm) or (6±5 mm) as will be detailed later with reference to embodiments of the present invention. Further, the term "substantially cylindrical part" refers to the main arc tube body extending between the both "end portions", so that the "end" of the "substantial cylindrical part" should mean the boundary between the substantial cylindrical part and the respective end portions. In the case of the arc tube of FIG. 3*b*, in particular, the tube is provided, in addition to substantially flattened end portions, with a radially inwardly projected plate PP extended along the inner surface of the substantial cylindrical part.

Figure 5:
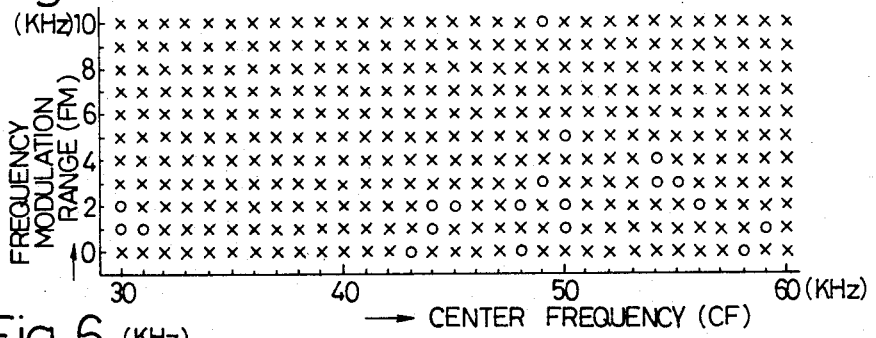
FIG. 5 is a graph showing the presence and absence of the acoustic resonance phenomenon presented on a plane of coordinate the abscissa and ordinate of which are the center frequency (CF) and the frequency modulation range (FM), respectively, the phenomenon having been observed in the case of the arc tube of FIG. 1 used.
Figure 6:
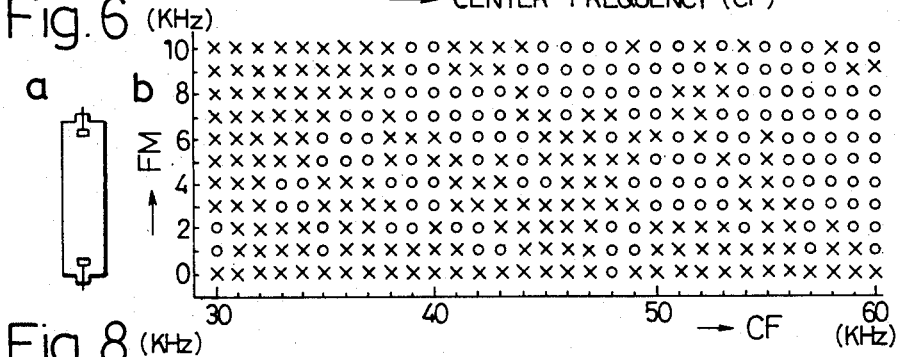
FIGS. 6*a* and 6*b* are respectively a schematic view of the arc tube in another embodiment according to the present invention, and a graph similar to FIG. 5 for showing the acoustic resonance phenomenon observed in the case of the arc tube of FIG. 6*a;*
Figure 7:
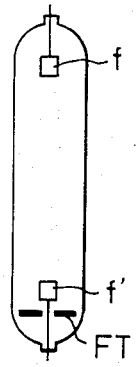
FIG. 7 is a schematic view showing a further embodiment of the arc tube for the lamp according to the present invention.

The AR phenomenon measurement has been performed with respect to both a conventional arc tube as depicted in FIG. 1 which is curved or spherical at both end portions, and an arc tube according to the present invention as depicted in FIG. 6*a* (substantially the same as that of FIG. 3*a*) substantially flattened at both ends. Their measurement is shown in the graphs of FIGS. 5 and 6*b*, respectively, in which the abscissa represents the center frequency (CF), the ordinate represents the frequency modulation range (FM) during the lighting of the arc tube, and circle mark "O" and cross mark "x" represent the zones where the AR phenomenon could be avoided (the avoidable zone) and could not be avoided (the instable zone), respectively. It will be clear from a comparison of the both graphs that, in the arc tube substantially flattened at both end portions, the AR phenomenon can be remarkably avoided at many zones of the center frequency higher than 30 KHz and of the frequency modulation range of 0 to 10 KHz. In the arc tube of FIG. 3*b* having therein the projected plate PP, the number of avoidable zones are further increased. In the case when a flat plate FT is provided within the arc tube as supported by a suitable means in the vicinity of one electrode f' to be perpendicular to the axis of the tube as shown in FIG. 7, substantially the same effect as in the arc tube substantially flattened at the end portions can be attained.

Figure 8:
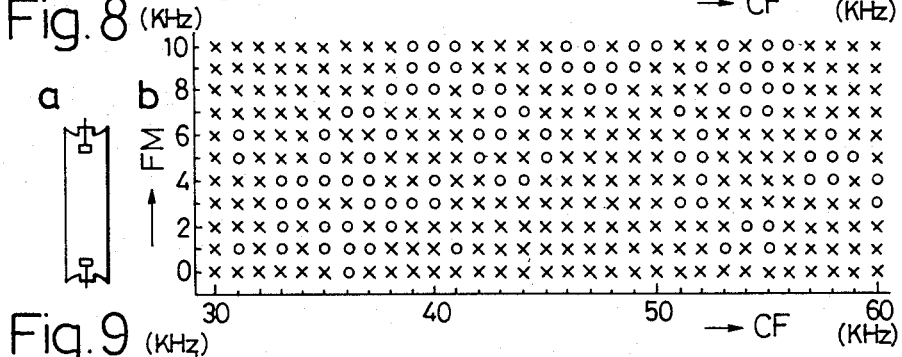
FIGS. 8*a*, 9*a*, 10*a* and 11*a* are schematic views of still further embodiments of the arc tube according to the present invention.
FIGS. 8*b*, 9*b*, 10*b* and 11*b* are graphs similar to FIG. 5 for showing the acoustic resonance phenomenon respectively observed in the case of each of the arc tubes of FIGS. 8*a*, 9*a*, 10*a*, and 11*a;*

According to another feature of the present invention, various other modifications of the configuration are suggested for the end portion of the arc tube. Referring to FIG. 8*a*, there is shown, as an example, an arc tube both end portions of which are curved axially inward, whereby the avoidable zones distributed in approximate manner to FIG. 6*b* can be obtained as shown in FIG. 8*b*.

Figure 9:
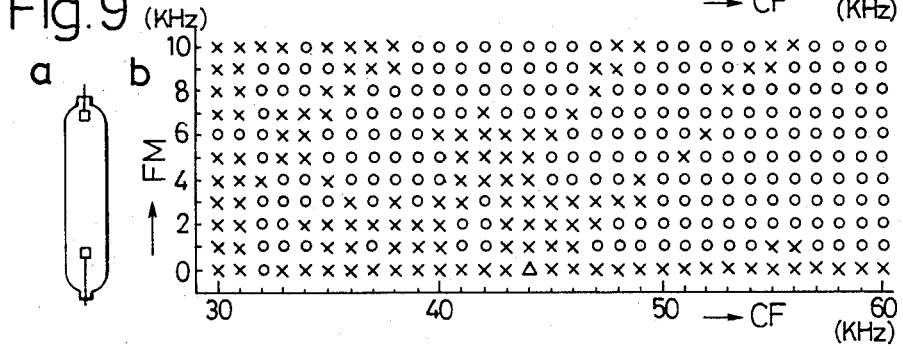
Figure 10:
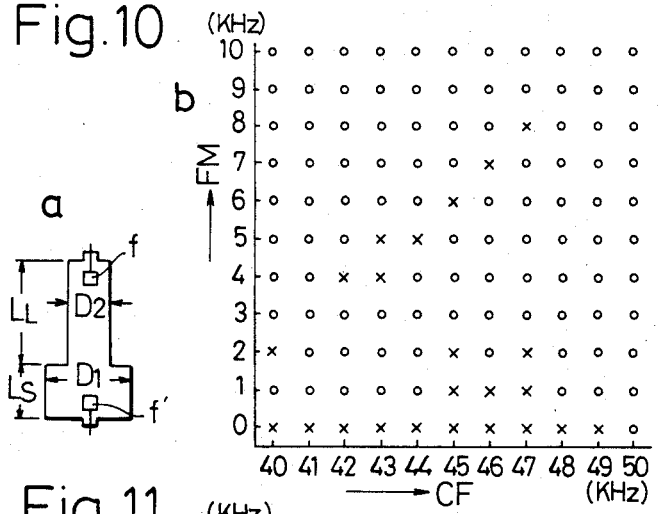
Figure 12:
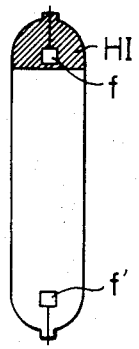
FIG. 12 shows schematically still another embodiment of the arc tube according to the present invention.
Figure 11:
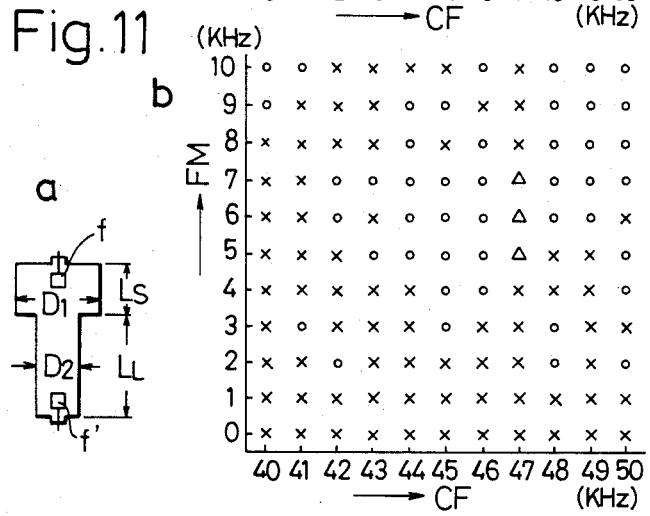

According to a further feature of the present invention, it is suggested, also for effectively avoiding the AR phenomenon, to modify the configuration of the arc tube so as to provide a temperature difference between the both end portions of the substantial cylindrical part. In such arc tube as shown in FIG. 9*a*, the axial length is made larger than any ordinary tubes, and one of the electrodes is elongated at the terminal stem to be longer than the other while opposing distance between the both electrodes is kept to be the same as that in conventional arc tubes, so that one end portion behind the electrode will be longer than the other. This arrangement effectively provides a temperature difference between the electrodes and many of the avoidable zones can be obtained as shown in FIG. 9*b* effectively in a broader range. According to another feature of the present invention, the arc tube is formed to have both of the substantially flattened end portions and the modified shape of providing the temperature difference between the both electrodes. Referring to FIG. 10*a*, the substantial cylindrical part of this arc tube comprises a larger-diametered part having a diameter of $D_1$ and a smaller-diametered part of a diameter $D_2$ and formed continuous to the former, a ratio of $D_1$ to $D_2$ being made to be 1:0.6, whereas the larger-diametered part is made to be of a length $L_S$ smaller than that $L_L$ of the smaller-diametered part, $L_S$ and $L_L$ being made to be of a ratio 1:2. In this arrangement, both end portions of the arc tube are substantially flattened and a temperature within the larger-diametered part on the side of the electrode f' is made lower than that within the smaller-diametered part on the side of the other electrode f, whereby the avoidable zones can be attained in such wider range as shown in FIG. 10*b*. FIG. 11*a* shows another arc tube which comprises similar different diametered parts to those of FIG. 10*a* but reversed in their positions so that the lower temperature will be attained on the side of the upper positioned electrode f, the measurement of the available zone of which arc tube being shown in FIG. 11*b*. As will be clear when FIGS. 10*b* and 11*b* are compared with each other, however, it is seen that the arc tube of FIG. 10*a* can attain more excellent results than that of the "reversed" tube of FIG. 11 *a*. In another embodiment of FIG. 12, an end portion of the arc tube on the side of the upper electrode f is coated on the outer surface with a heat insulating film HI of such a material as zirconium oxide or the like so that, when the tube is operated with the high frequency power frequency-modulated, the tube can provide a temperature difference between the electrodes f and f' so as to attain the avoidable zones effectively in a wide range.

Figure 13:
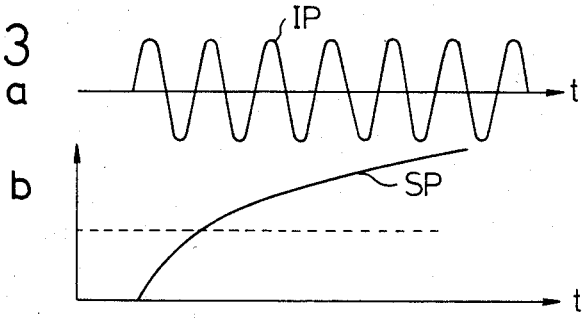
FIGS. 13 to 15 are graphs for explaining operational characteristics of other embodiments of the high pressure discharge lamp according to the present invention.
Figure 14:
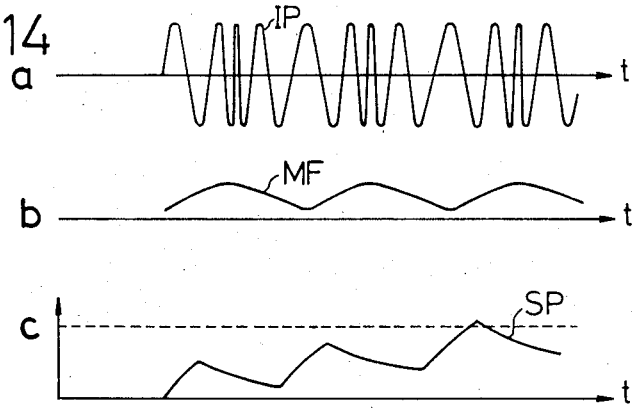
Figure 15:
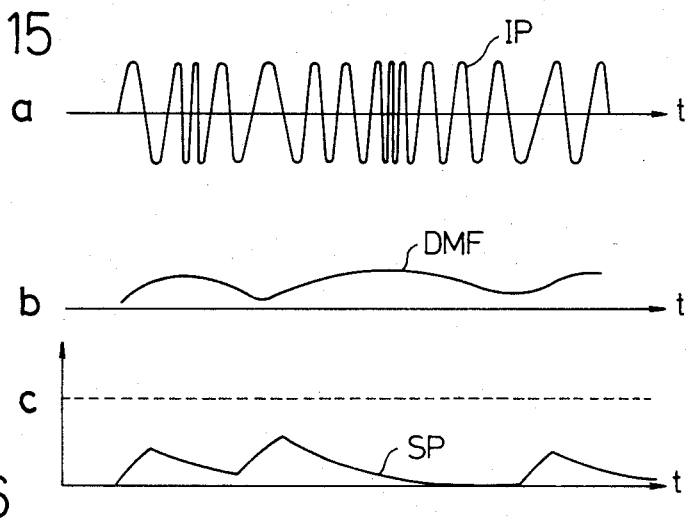

In driving the arc tube of high pressure discharge lamp with a high frequency through the frequency modulation, further, the high frequency may be further modulated to reduce the possibility of causing the AR phenomenon to occur in the arc tube, for the purpose of favourably obtaining the avoidable zones. During the high frequency lighting of the arc tube with such input power IP of a constant high frequency as shown in FIG. 13*a*, in general, the stationary wave should arise upon coincidence of the inner pressure variation due to time varition under application of the input IP, with the natural frequency of the tube determined by its configuration and charged substances and, when this stationary wave SP grows with time elapsed a shown in FIG. 13*b* to exceed a critical sound pressure level shown by a broken line in the drawing, the arc column generated between the electrodes in the tube is thereby caused to be badly influenced. As a counter measure therefor, the input power IP is modulated with such a constant modulation frequency MF as shown in FIG. 14*b* so as to be as shown in FIG. 14*a* and it becomes less possible that the stationary wave SP exceeds the critical level as shown in FIG. 14*c*. Such growth of the stationary wave can be further restricted by further modulating the frequency-modulated input power IP with a so-called double modulation frequency DMF as shown in FIG. 15*b* and obtained by modulating the modulation frequency MF with another constant modulation frequency so that the input power IP will be as shown in FIG. 15*a*, whereby the stationary wave SP that tends to grow is caused to remarkably attenuate as shown in FIG. 15*c* and thus the AR phenomenon can be effectively avoided.

Figure 16:
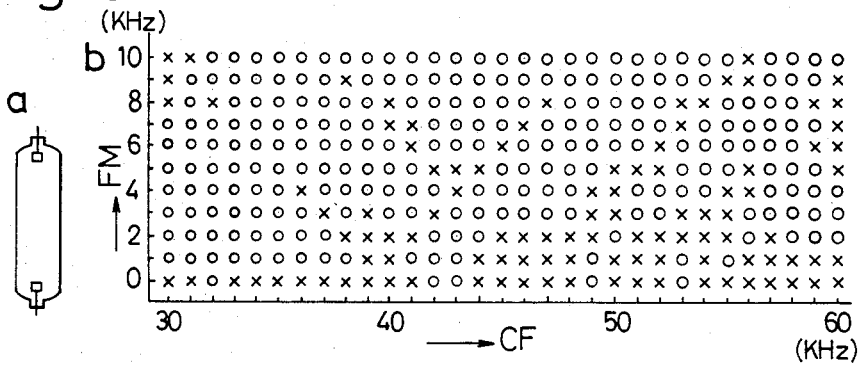
FIGS. 16*a* and 16*b* are respectively a schematic elevation of a further embodiment of the arc tube for the lamp according to the present invention, and a graph similar to FIG. 5 for showing the acoustic resonance phenomenon observed in the case of the tube of FIG. 16*a;*
Figure 18:
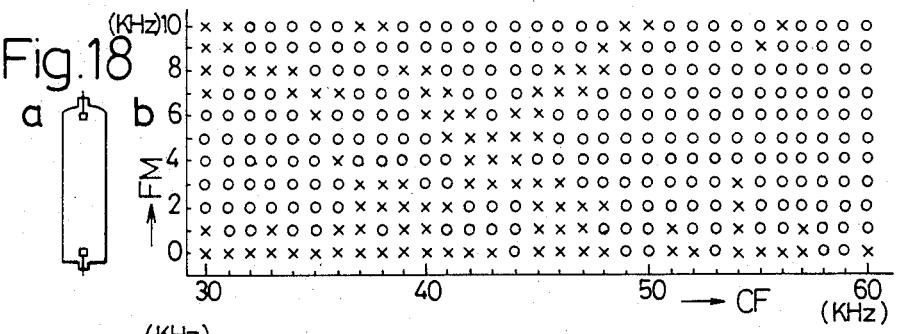
FIGS. 18*a,* 19*a,* 20*a* and 21*a* show schematically still further embodiments of the arc tube for the lamp according to the present invention.
FIGS. 18*b,* 19*b,* 20*b* and 21*b* are graphs similar to FIGS. 5 for showing the acoustic resonance phenomenon observed respectively in the case of each of the various arc tubes of FIGS. 18*a,* 19*a,* 20*a* and 21*a;*
Figure 19:
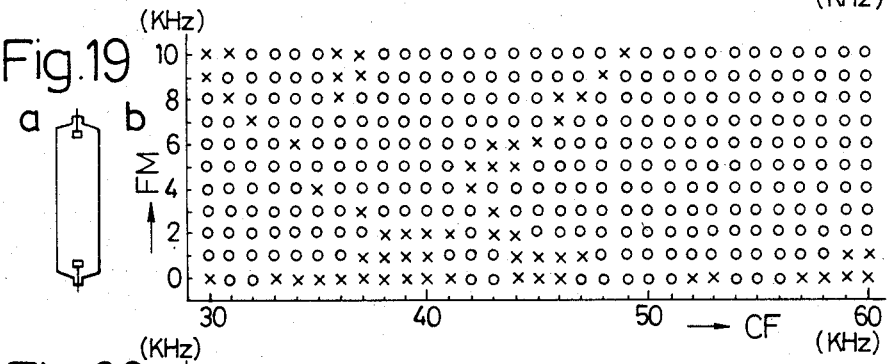
Figure 20:
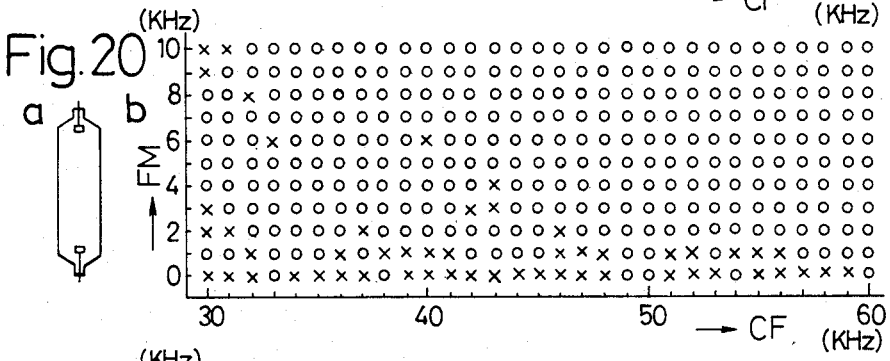
Figure 21:
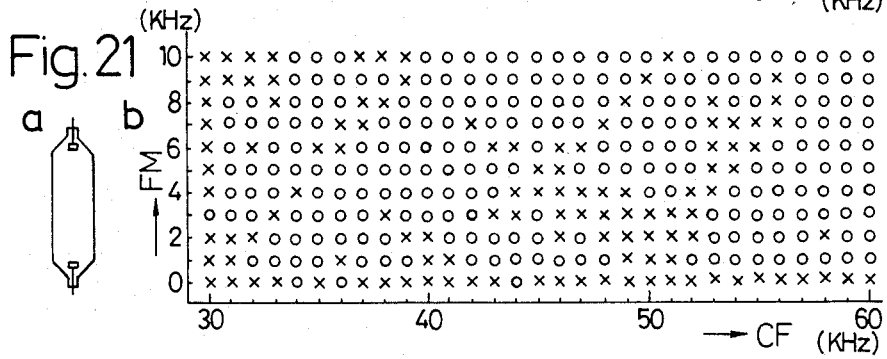
Figure 30:
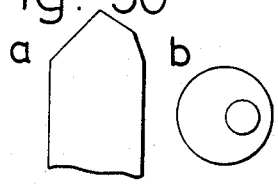
Figure 31:
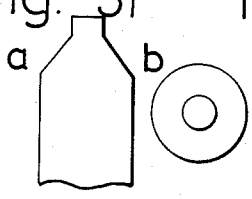
Figure 32:
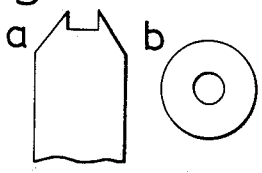

According to the present invention, a further suggestion is made for the modification of the end portion of the substantial cylindrical part in the arc tube. Referring to FIG. 16*a*, the substantial cylindrical part is made leniently spherical but with a curvature considerably made smaller than that of the arc tube of, for example, FIG. 1, so as to be more or less flat. FIG. 16*b* shows results of the measurement, which prove that this arc tube achieves the avoidable zones in a sufficiently broad range. In this connection, as shown in a graph of FIG. 17, the percentage of the instable zones observed in the tube of FIG. 16*a* has been plotted in relation to a quotient of the length $L_r$ at the lenient spherical end portion of the arc tube divided by the inner diameter 2R of the tube, and a curve FMR has been obtained. In the drawing, a mark "x" represents a result of measurement obtained in respect of the known arc tube of FIG. 1. It has been found that, in the case of the arc tube of FIG. 16*a*, the ratio of the dimension of the tube end portion to the inner diameter at the substantial cylindrical part DTE/ID should be $(3\pm3)/15$ or, preferably, $(3\pm2)/15$. Alternatively, the arc tube may be so formed as to be leniently spherical at one end portion of the substantial tube part as in the case of FIG. 16*a* but to be flat at the other end portion, as shown in FIG. 18*a*, in which event the AR phenomenon can be avoided in such a wide range as shown in FIG. 18*b* similarly to FIG. 16*b*.

Figures 17, 22, 23, 24, 25, 26, 27, 28, 29:
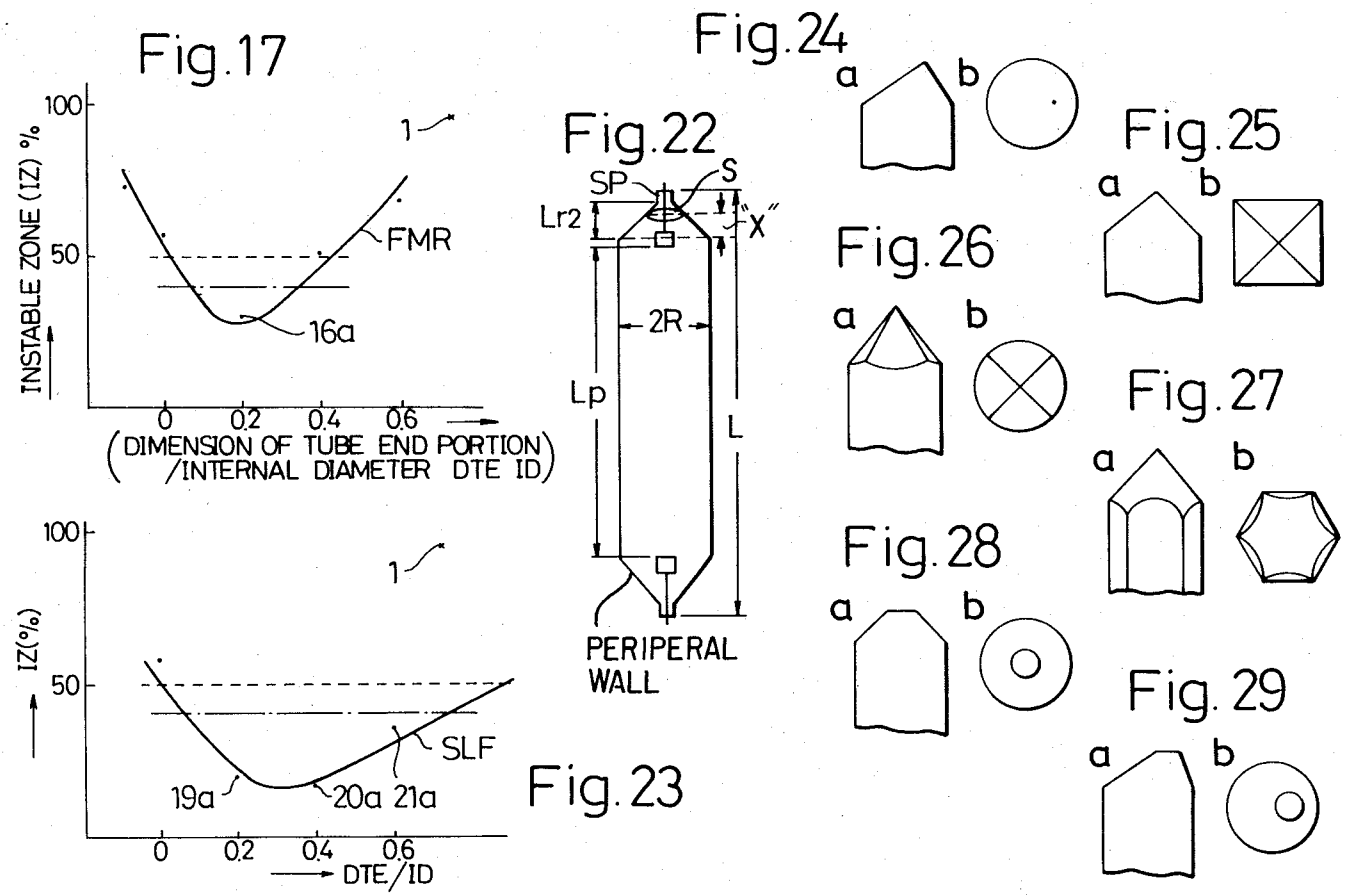
FIG. 17 is a graph showing the rate of the instable zone in percentage with respect to the configuration and dimension at an end portion of the arc tube of the high pressure discharge lamp.
FIG. 22 is an enlarged schematic view of the arc tube in any of FIGS. 19 to 21 for explaining its dimensions.
FIG. 23 is a graph similar to FIG. 17 for showing the rate of the instable zone with respect to the end portion of the tube of FIG. 22.
FIGS. 24 to 32 are fragmental views at one end portions in other embodiments of the arc tube for the high pressure discharge lamp according to the present invention, wherein (a) is their side elevation and (b) is their top view, respectively.

According to still another feature of the present invention, the end portions of the arc tube are made to linearly outwardly bulge in their side elevation, so as to be conical as shown in FIG. 22. Referring to FIGS. 19*a* to 21*a*, the conical end portions are modified to have three different heights. The measurement of the avoidable zones observed in these arc tubes is shown in each of FIGS. 19*b* to 21*b*, and it is seen that the AR phenomenon can be excellently avoided in extensively wide range with these arc tubes. In the present instance, the percentage of the instable zones observed in these tubes with respect to a quotient of the axial length $L_{r2}$ of the concial tube end portions (see FIG. 22) divided by the inner diameter 2R of the substantial cylindrical part of these arc tubes is shown by a curve SLF in FIG. 23. In the drawing, a mark "x" represents a result of measurement obtained with respect to the known arc tube of FIG. 1. It has been found that, in the case of such arc tube having the linear conical end portions, the ratio of the dimension of the end portion to the inner diameter of the substantial cylindrical part (DTE/ID) should be $(6\pm6)/15$ or, desirably, $(6\pm5)/15$.

In the foregoing measurement of FIG. 17 as well as FIG. 23, an arc tube having the inner diameter 2R of 15 mm, inter-electrode distance $L_p$ of 55 mm and output of 250W has been used as a high pressure discharge lamp.

According to the present invention, various modifications of the conical end portions of the arc tube may be provided as shown in FIGS. 24 to 32, in which the peripheral wall of the end portion is still linear in the side elevation. Referring to them more particularly,the arc tube FIG. 24*a* and 24*b* has a conical end portion the apex of which is eccentric with respect to the axis of the substantial cylindrical part, the tube of FIG. 25*a* and 25*b* is of a quadrangular prism in the main body part and quadrangular pyramid at the end portion, the tube of FIG. 26*a* and 26*b* is cylindrical in the main body part but is of a quadrangular pyramid at the end portion, the tube of FIG. 27*a* and 27*b* is of a circular cone at the end portion but is hexagonal prism in the main body part, the tube of FIGS. 28*a* and 28*b* has a truncated-conical end portion and cylindrical body part, FIG. 29*a* and 29*b* is of a truncated-conical end portion having an eccentric top face and cylindrical body part, FIG. 30*a* and 30*b* is of a truncated-conical end portion having a tilted and eccentric top face with respect to the cylindrical body part, FIG. 31*a* and 31*b* is of a generally truncated-conical end portion the top face of which is projected axially outwardly, and FIG. 32*a* and 32*b* is of a generally truncated-conical end portion the top face of which is recessed axially inwardly. The tubes having the end portions of such configurations as shown are effective to avoid the AR phenomenon respectively in wide range. In FIGS. 24 to 32, the axial projections for the hermetical electrode holding have been omitted.

Figure 33:
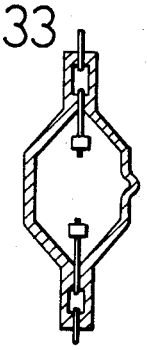
FIG. 33 is a schematic sectional view in a different embodiment of the arc tube for a small high pressure discharge lamp according to the present invention.

As another aspect of the present invention, the foregoing linearly bulged end portion is employed in the arc tube for a small high-pressure discharge lamp of an output less than 250W, while effectively avoiding the AR phenomenon. In the case of such small high-pressure discharge lamp, there is employed such an arc tube formed conical at both end portions of a relatively short cylindrical part as shown, for example, in FIG. 33, the ratio DTE/ID of which is selected to be preferably (6±5)/15. This arc tube can avoid the AR phenomenon substantially to the same extent as in the foregoing high-pressure discharge lamp of 250W.

Figure 35:
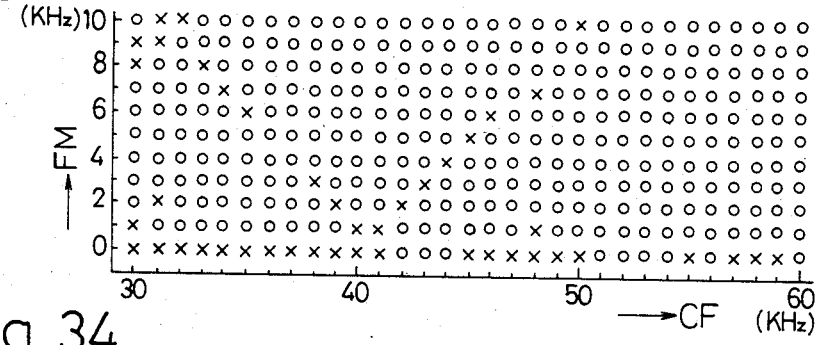
FIG. 35 is a graph similar to FIG. 5 for showing the acoustic resonance phenomenon observed in the case of the arc tube of FIG. 34.
Figure 34:
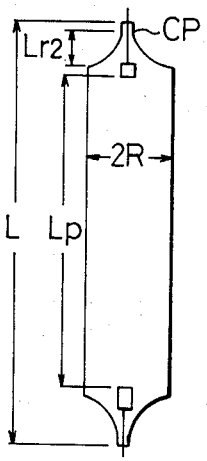
FIG. 34 is a schematic elevation in another embodiment of the arc tube according to the present invention.

According still another feature of the present invention, the arc tube is formed to have substantially conical end portions of which the peripheral surface is curved rather inward, so as to effectively increase the avoidable zones. Referring to FIG. 34, the both end portions of the arc tube of this feature are horn-shaped in the side elevation to be abruptly constricted at the central part projected outward, whereby the avoidable zones can be obtained substantially all over the operational range as shown in the graph of FIG. 35. Varying differently the length $L_{r2}$ of the end portions of such arc tube, that is, with a plurality of the arc tubes having the horn-shaped end portions of different curvatures, the avoidable zones thereby achieved were observed, and the percentage of the instable zones plotted with respect to the quotient (DTE/ID) of the length $L_{r2}$ divided by the inner diameter 2R of the tube has shown such a result as represented by a curve FMR of FIG. 36. In the case of the arc tube having the horn-shaped end portions, the ratio DTE/ID should preferably be made to be above 0.07. In carrying out the measurement of FIG. 36, the arc tubes of an inner diameter 2R of 15 mm, inter-electrode distance $L_p$ of 55 mm and an output of 250W for use in the high-pressure discharge lamp of 250W were used.

Figure 36:
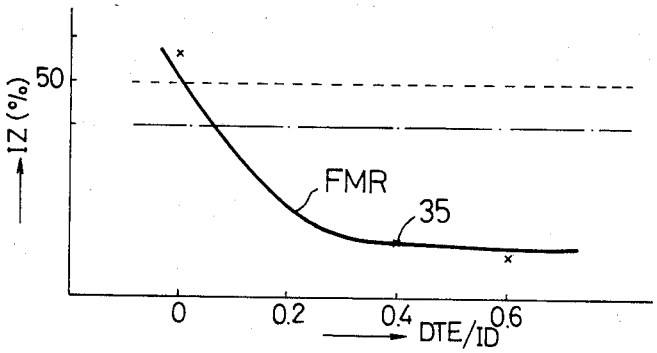
FIG. 36 is a graph similar to FIG. 17 for showing the rate of the instable zone with respect to the dimensions and configuration at the tube end portion of the arc tube of FIG. 34.

As will be clear from FIGS. 17 and 23 as well as FIG. 36, the length $L_r$ at the end portions of the arc tube is so set that the instable zones will be made desirably less than 50%, optimumly less than 40%, in the latter event of which the instable zones can be practically kept at least less than 50% notwithstanding a presence of any manufacturing tolerance, such as fluctuations in the dimensions of the arc tube, constants of the lighting circuit and the like.

Figure 37:
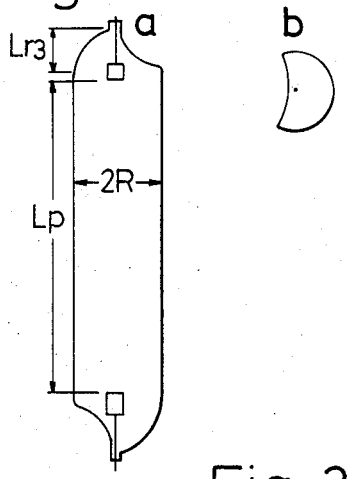
FIGS. 37*a* and 37*b* are achematic elevation and top plan view in a further embodiment of the arc tube for the lamp according to the present invention.
Figure 39:
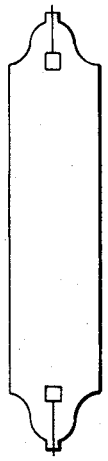
FIGS. 39 and 40 are schematic views of further different embodiments of the arc tube for the lamp according to the present invention.
Figure 40:
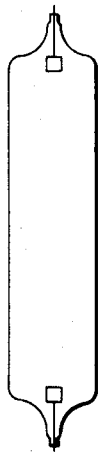
Figure 38:
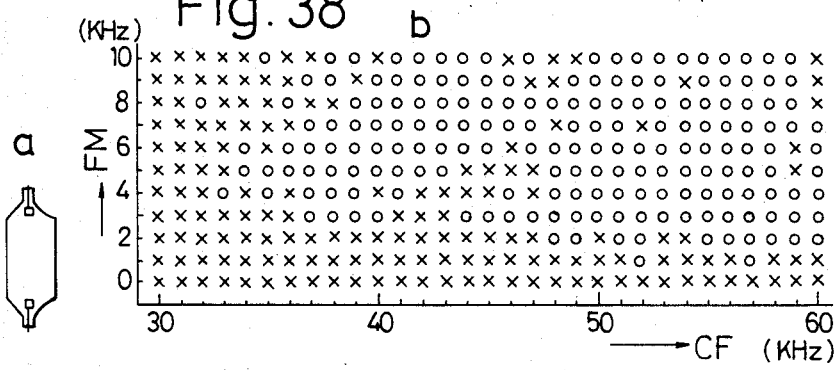
FIGS. 38*a* and 38*b* are respectively a schematic elevation in a different embodiment of the arc tube for the lamp acccording to the present invention, and a graph similar to FIG. 5 for showing the acoustic resonance phenomenon observed in the case of the arc tube of FIG. 38*a;*

According to another feature of the present invention, further, the AR phenomenon can be effectively avoided even by forming the end portion or portions of the arc tube so as to satisfy the foregoing equation (1) only at a local part on a single side of the axis of the tube on a plane at the end of the substantial cylindrical part, while the other side of the end portion may be formed in known manner as, for example, curved outward. As shown in FIGS. 37*a* and 37*b*, the end portions may be substantially flattened only at one side part of the electrode by having part of the periphery of the portion curved inward, as seen in FIG. 37*a*. Further, such locally flattened parts may be provided at the both end portions either in the point symmetry as in FIG. 37*a* or in the axial symmetry as in FIG. 38*a*, in the event of the latter of which, too, the instable zones can be made less than 50% as seen in FIG. 38*b*. In the case of the horn-shaped end portions such as in FIG. 34 where the periphery of the end portion is substantially flattened partially circumferentially, further, the central part or peripheral edge part of the end portion may be rounded as shown in FIGS. 39 and 40.

Figure 41:
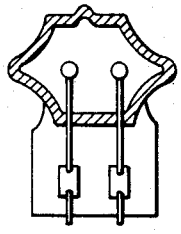
FIGS. 41 to 43 are schematic sectional views in further different embodiments of the arc tube for the small high pressure discharge lamp according to the present invention.
Figure 42:
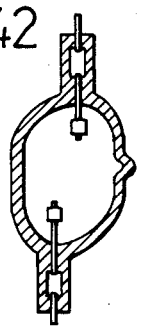
Figure 43:
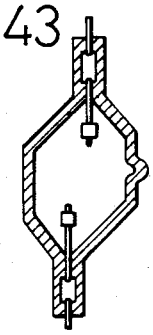

When the arc tube specifically for the small high-pressure discharge lamp is provided with the horn-shaped end portions, both of the paired electrodes may be disposed in the central position of the tube as shown in FIG. 41, as hermetically held at the same end portion. In the case when the electrodes are positioned eccentric with respect to the tube axis or in the point symmetry as shown in FIGS. 42 and 43, the length of the curved or conical end portions of the tube for the small high-pressure discharge lamp can be made sufficiently long. Accordingly, it is made possible to keep the temperature at the end portions to be high, and to avoid the AR phenomenon effectively, without deterioration in the luminous efficiency nor in luminous coloring.

Figure 44:
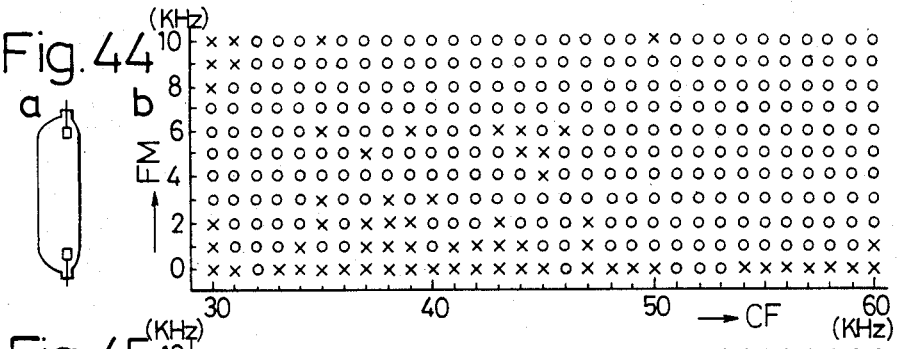
FIGS. 44*a,* 45*a* and 46*a* are schematic views in different embodiments of the arc tube according to the present invention.
FIGS. 44*b,* 45*b* and 46*b* are graphs similar to FIG. 5 for showing the acoustic resonance phenomenon observed respectively in the case of each of the different arc tubes of FIGS. 44*a,* 45*a* and 46*a;*
Figure 45:
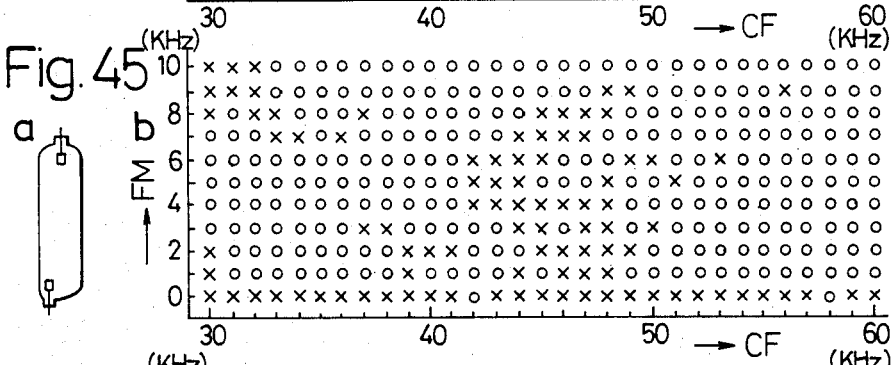
Figure 46:
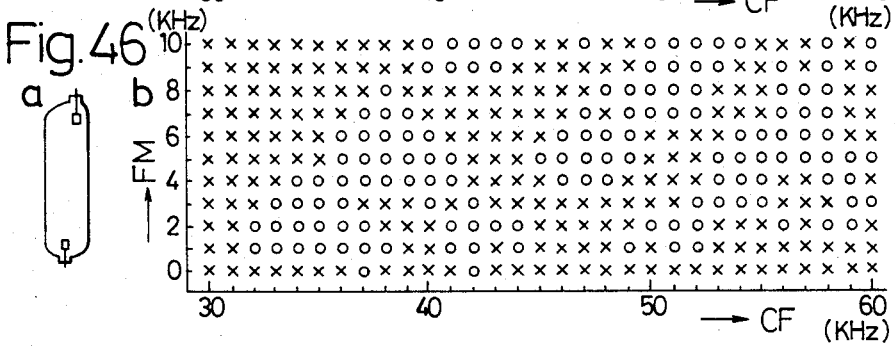

In addition, as has been partly referred to in connection with FIGS. 24 to 32, it is also effective to position the apexes of the both curved end portions to be eccentric. That is, when the apexes are deviated to one side of the axis of the tube as shown in FIG. 44*a*, the avoidable zones can be highly favourably obtained as shown in FIG. 44*b*. In this connection, only one of the end portions may be so curved as to have its apex deviated and, when such apex-deviated end portion is provided at the lower end as shown in FIG. 45*a*, the avoidable zones can be attained in such wider range as shown in FIG. 45*b* than in the case where the apex-deviated end portion is provided at the upper end as shown in FIG. 46*a*, the measurement of which is shown in FIG. 46*b*.

The foregoing arc tubes explained with reference to FIGS. 1 to 46 have been described to be lighted as mounted vertically, with the arc column thus generated vertically. When they are placed horizontal and lighted, a floating force will act on the arc column horizontally generated so as to stabilize the same, and any influence of the AR phenomenon on the arc column will be reduced. Accordingly, an application of the foregoing arrangement according to the present invention to such horizontally lighted arc tubes effectively renders the instable zone to be substantially negligible. In practice, the present invention is applicable to any arc tubes irrespective of their lighting posture, including vertical, horizontal and even tilted lightings.

Figure 49:
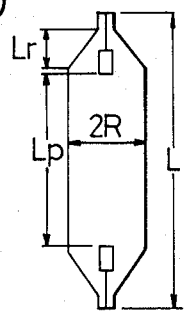
FIG. 49 is a schematic view of the arc tube used for the observations of FIG. 47.
Figure 48:
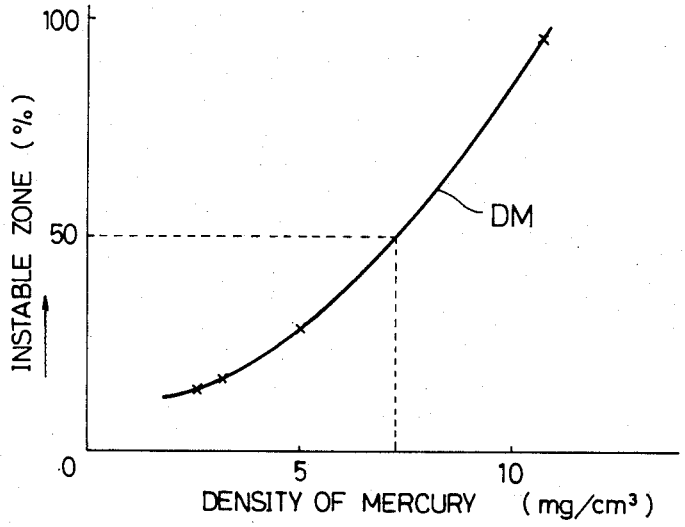
FIG. 48 is a graph showing the rate in percentage of the instable zone with respect to the different mercury vapor densities employed for the graphs of FIG. 47.

According to another feature of the present invention, the avoidable zones can be effectively obtained by restricting the mercury vapor density to be below a predetermined value. FIGS. 47*a* to 47*d* show the avoidable and instable zones observed in an arc tube the mercury vapor density in which is increased while maintaining the input power constant. The measurement of the percentage of the instable zones plotted with respect to the mercury vapor density within the arc tube has resulted in such a curve DM as in FIG. 48. It will be seen from the curve that, when the mercury vapor density is below 7.5 mg/cm$^3$, the instable zones can be made to be less than 50%. For this measurement, arc tubes of the shape of FIG. 49 which is similar to the one of FIG. 21*a* or 22 and having commonly the inner diameter of 15 mm and end portion length of 6 mm but different inter-electrode distances of 80 mm for FIG. 47*a*, 60 mm for FIG. 47*b*, 40 mm for FIG. 47*c* and 20 mm for FIG. 47*d* have been employed.

Figure 50:
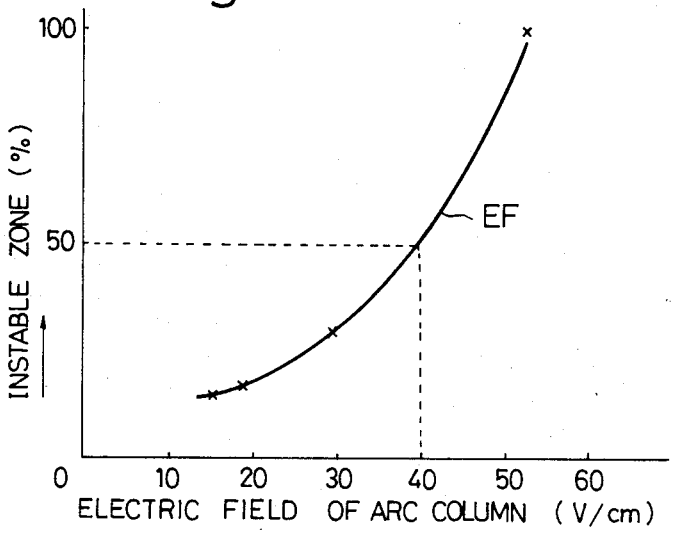
FIG. 50 is a graph showing the rate in percentage of the instable zone with respect to the field strength of the discharge arc column in the case of a different embodiment of the arc tube for the lamp according to the present invention.

According to still another feature of the present invention, the effective avoidable zones are attained by limiting the electric field strength of arc column to be below a predetermined value. With the arc tube of FIG. 49 used while varying the inter-electrode distance, the percentage of the instable zones was measured as plotted, and results were as shown by a curve EF in FIG. 50. It will be understood from the curve that, when the electric field strength of arc column is below 40 V/cm, the instable zones can be made less than 50%.

Figure 52:
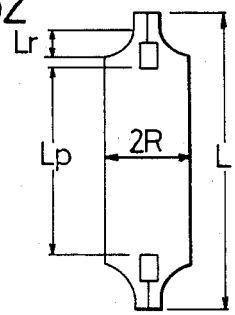
FIG. 52 is a schematic elevation of the arc tube in a still different embodiment according to the present invention and used for the observation of FIG. 51*d.*
Figure 47:
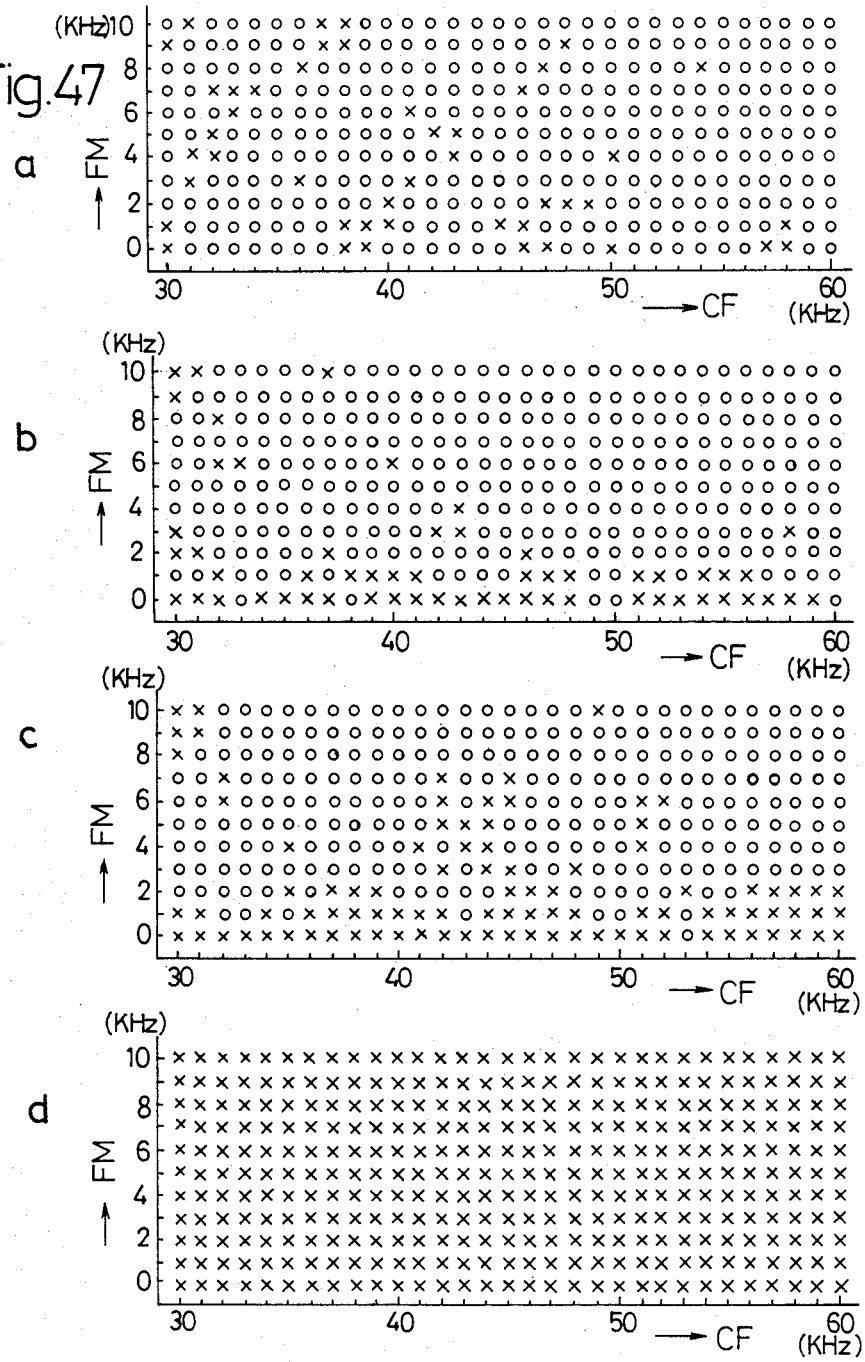
FIGS. 47*a* through 47*d* are graphs also similar to FIG. 5 for showing the acoustic resonance phenomenon observed respectively in the case of four different mercury vapor densities achieved in an arc tube shown in FIG. 49 according to the present invention.
Figure 51:
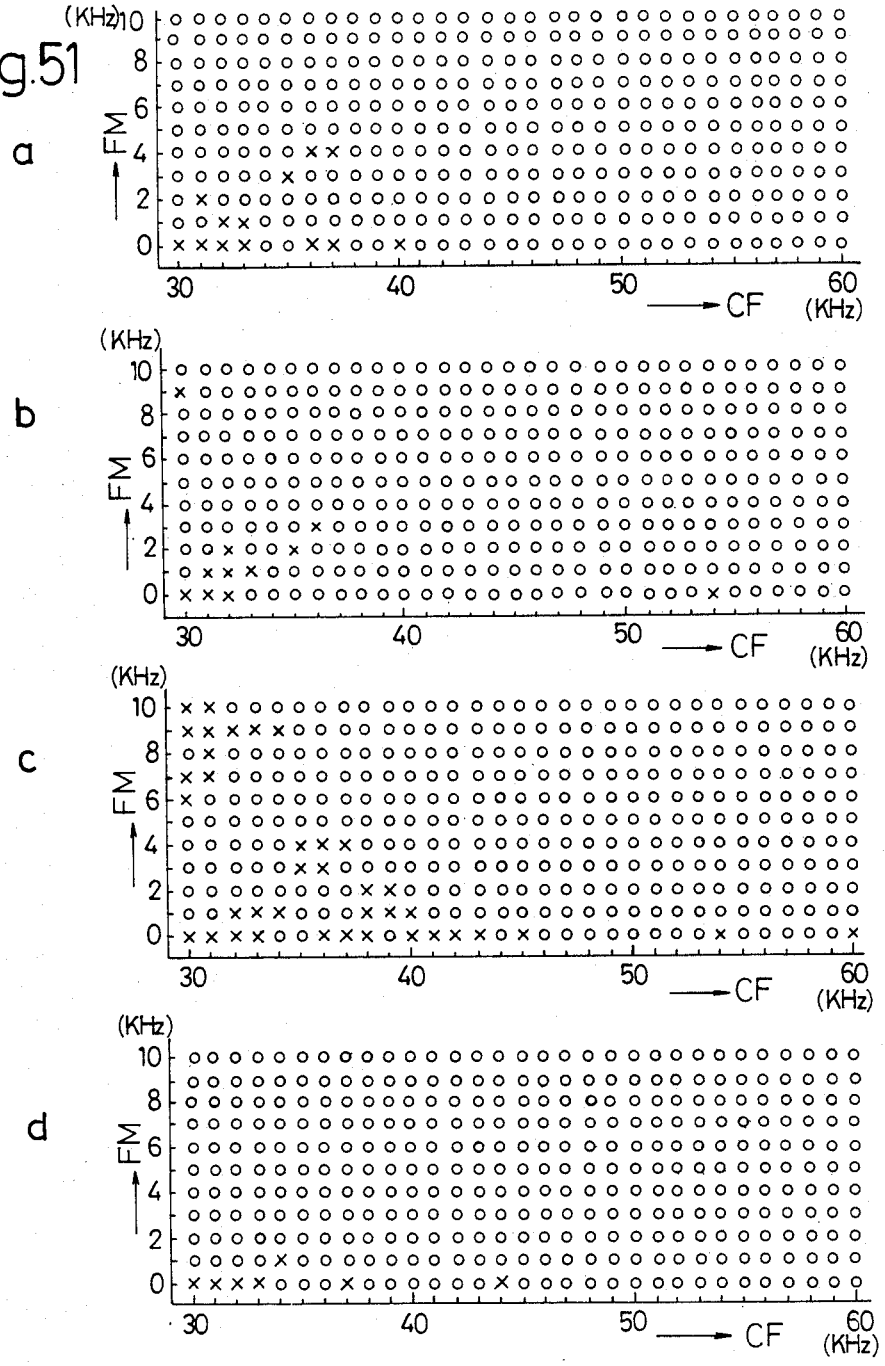

Even when the present invention is applied to such a high pressure discharge lamp as the one of 400W, substantially the same extent of the avoidable zones can be attained. Referring here to FIGS. 51*a* through 51*d*, FIGS. 51*a* to 51*c* in which show results of the measurement of the avoidable and instable zones respectively in the case of the same arc tubes as in FIG. 49 which are commonly of the inner diameter of 18 mm and inter-electrode distance of 75 mm but of different end portion length of 3 mm, 6 mm and 9 mm, from which it will be appreciated in every case that the instable zones are made to be less than 12%. On the other hand, FIG. 51*d* shows the measurement in the case of the arc tube of FIG. 52 similar to the one of FIG. 34 which has the inner diameter of 18 mm, inter-electrode distance of 75 mm and an end portion length of 6 mm, and the instable zones are seen to have been made substantially negligible. In all measurement of FIGS. 51*a* through 51*d*, the arc tubes employed therefor have been kept to be under such conditions that the mercury vapor density inside the tube is 2.3 mg/cm$^3$ and the arc column electric field strength is 14.9 V/cm.

What is claimed as our invention is:

1. A high pressure discharge lamp comprising an arc tube having a substantially cylindrical portion closed by opposed end portions hermetically holding electrode filaments within said substantially cylindrical portion, said arc tube being housed in an outer jacket and lighted by a frequency modulated power from a high frequency power source for avoiding acoustic resonance phenomenon, where at least a part of said end portions of said arc tube satisfies an equation $S \leqq \pi D^2(\frac{1}{2}-(5/11)x)^2, 0<x<11/15$ where D is the inner diameter (mm) of the arc tube at said substantial cylindrical part, S is a sectional are (mm$^2$) bounded by a peripheral wall of one of said end portions, X is a quotient of a distance "x" (mm) divided by said inner diameter D, said distance "x" being from a first point on a longitudinal axis of said lamp, which first point is coincident with said sectional area S, to a second point on said axis, which second point is on an imaginary radial plane passing through an intersection of said substantially cylindrical portion and said one end portion.

2. A lamp according to claim 1, wherein at least one of said end portions of said arc tube is made substantially flat.

3. A lamp according to claim 2, wherein said quotient is of a length of said end portions of said arc tube divided by said inner diameter of the tube, being $(2\pm2)/15$.

4. A lamp according to claim 1, wherein at least one of said end portions of said arc tube is formed to have a linear peripheral wall.

5. A lamp according to claim 4, wherein said quotient is of a length of said end portions of said arc tube divided by said inner diameter of the tube, being $(6\pm5)/15$.

6. A lamp according to claim 1, wherein at least one of said end portions of said arc tube has a part curved inward with respect to the axis of the tube.

7. A lamp according to claim 6, wherein said quotient is of a length of said end portions of said arc tube divided by said inner diameter of the tube, being $(6\pm5)/15$.

8. A lamp according to claim 1, wherein the apex of said end portions of said arc tube is positioned to be eccentric to the axis of the tube.

9. A lamp according to claim 1, wherein said arc tube has a density of mercury vapor kept at a value below 7.5 mg/cm$^3$.

10. A lamp according to claim 1, wherein said arc tube has an electric field strength of arc column kept at a value below 40 V/cm.

* * * * *